US005184606A

United States Patent [19]

Csorba

[11] Patent Number: 5,184,606

[45] Date of Patent: Feb. 9, 1993

[54] DEVICE FOR CARDIAC MASSAGE

[76] Inventor: George Csorba, Box 4, River Road,, Murrabit, Victoria 3579, Australia

[21] Appl. No.: 750,074

[22] Filed: Aug. 26, 1991

[51] Int. Cl.[5] ..... A61H 31/00

[52] U.S. Cl. ..... 128/28; 128/44; 128/54

[58] Field of Search ..... 128/44, 28, 54, 30.2, 128/71, 52, 33, 25 R

[56] References Cited

U.S. PATENT DOCUMENTS

| | | | |
|---|---|---|---|
| 3,209,747 | 10/1965 | Guentner . | |
| 3,219,031 | 11/1965 | Rentsch | 128/28 |
| 3,401,686 | 9/1968 | Edwards | 128/54 |
| 3,552,390 | 1/1971 | Muller | 128/52 |
| 3,782,371 | 1/1974 | Derouineau | 128/28 |
| 3,965,893 | 6/1976 | Ragailler | 128/145.8 |
| 5,078,125 | 1/1992 | Schumacher | 128/33 |

*Primary Examiner*—Robert A. Hafer

*Assistant Examiner*—David Kenealy

*Attorney, Agent, or Firm*—Larson and Taylor

[57] ABSTRACT

A portable device for cardiac massage comprises a portable case 10 having a lid 20, the case is adapted to accommodate an extensible lever 50, one end of which is adapted to be pivotally detachable from one of a variety of positions within the case 10, a contact pad 60 is pivotally secured to the lever 50 to project downwardly from the lever. In use the lid 20 is laid on a flat surface with the case 10 extending substantially vertically and the end of the lever 50 is pivotally attached to a selected position on the case 10. The patient is laid chest upwards on the lid 20 and the contact pad 60 is positioned over the sternum of the patient so that cardiac massage can be applied to the patient by a downward force on the free end 54 of the lever 50. When the device is not in use the lever 50 is stored within the case 10.

6 Claims, 3 Drawing Sheets

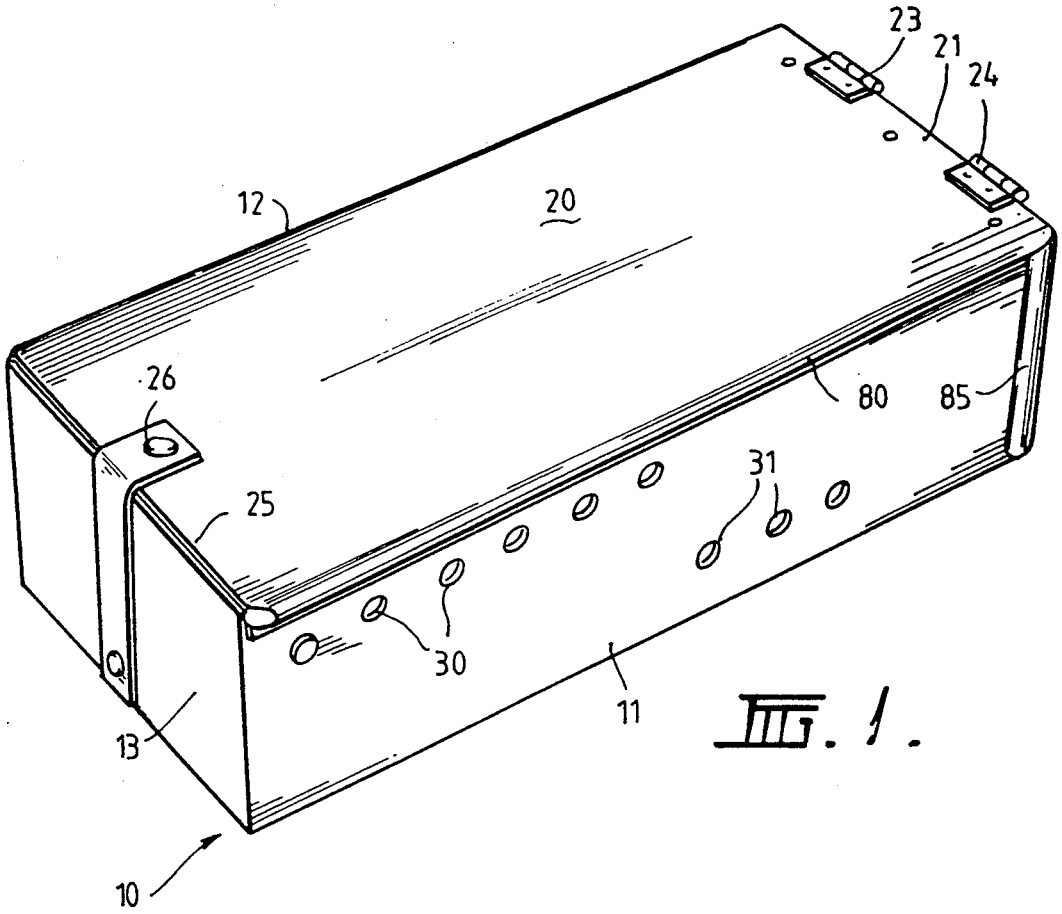
FIG. 1.
FIG. 3.
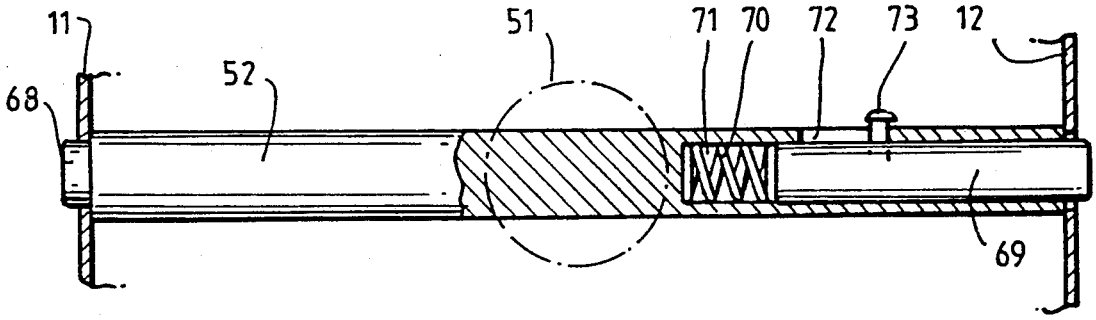

DEVICE FOR CARDIAC MASSAGE

FIELD OF THE INVENTION

This invention relates to a device for cardiac massage and in particular relates to a portable device that can be used by unskilled personnel to apply cardiac massage.

PRIOR ART

There is often a need for cardiac massage at the scene of a drowning, electrocution, heart attack or asphyxiation. It is a well known medical fact that it is possible to resuscitate the heart of a patient even after the heart has stopped. A skilled medical practitioner can re-start the heart by use of cardiac massage that essentially comprises the application of periodic downward force on the sternum of the patient. The application of this force can take place over a lengthy period and can prove particularly fatiguing to untrained personnel. Without additional equipment, it is often difficult to apply the necessary force to the chest of the patient whilst at the same time be free to apply other means of assistance such as mouth to mouth resuscitation.

There have been a number of proposals that concern devices that assist cardiac massage. In U.S. Pat. Nos. 3,965,893, 3,782,371, 3,219,031 and 3,209,747, there are disclosures of a variety of devices that can be used to apply cardiac massage. Some of the devices are large, complicated and expensive and thus difficult to transport. There is thus a need for a simple portable device that could be unobtrusively carried on a vehicle and can be used by an untrained operator to successfully apply cardiac massage.

It is an object of this invention to provide a solution to this problem.

SUMMARY OF THE INVENTION

According to the present invention there is provided a portable device for cardiac massage comprising a portable case having a lid, the case being adapted to accommodate an extensible lever, one end of which is adapted to be pivotally detachable from one of a variety of positions within the case, a contact pad pivotally secured to the lever to project downwardly from the lever, whereby in use the lid is laid on a flat surface with the case extending substantially vertically and the end of the lever is pivotally attached to a selected position on the case, the patient is laid chest upwards on the lid and the contact pad is positioned over the sternum of the patient and whereby cardiac massage can be applied to the patient by a downward force on the free end of the lever.

Preferably the lever is in two parts, a first part having the end pivotally detachable from the case and a second part arranged to be sliding telescopic fit within the first part, the contact pad being pivotally secured to the second part whereby displacement of the second part relative to the first part varies the length of the lever and varies the distance of the contact pad from the case. In a preferred embodiment, means is provided to lock the two parts of the lever in a preselected position. In one embodiment, the contact pad is vertically displaceable about the lever about biasing means. An audible warning may be provided to provide an indication when the downward forces exceeded a predetermined limit.

The lid of the case is preferably pivotally attached to the case and means are provided to lock the lid in an open position perpendicular to the case.

Preferably the case is adapted to store the lever when not in use.

BRIEF DESCRIPTION OF THE DRAWINGS

One embodiment of the present invention will now be described by way of example only with reference to the accompanying drawings in which:

FIG. 1 is a perspective view illustrating the device when stored away in a case;

FIG. 3 is a cross-sectional view taken along the lines 3—3 of FIG. 2;

DESCRIPTION OF THE EMBODIMENT

Figure 2:
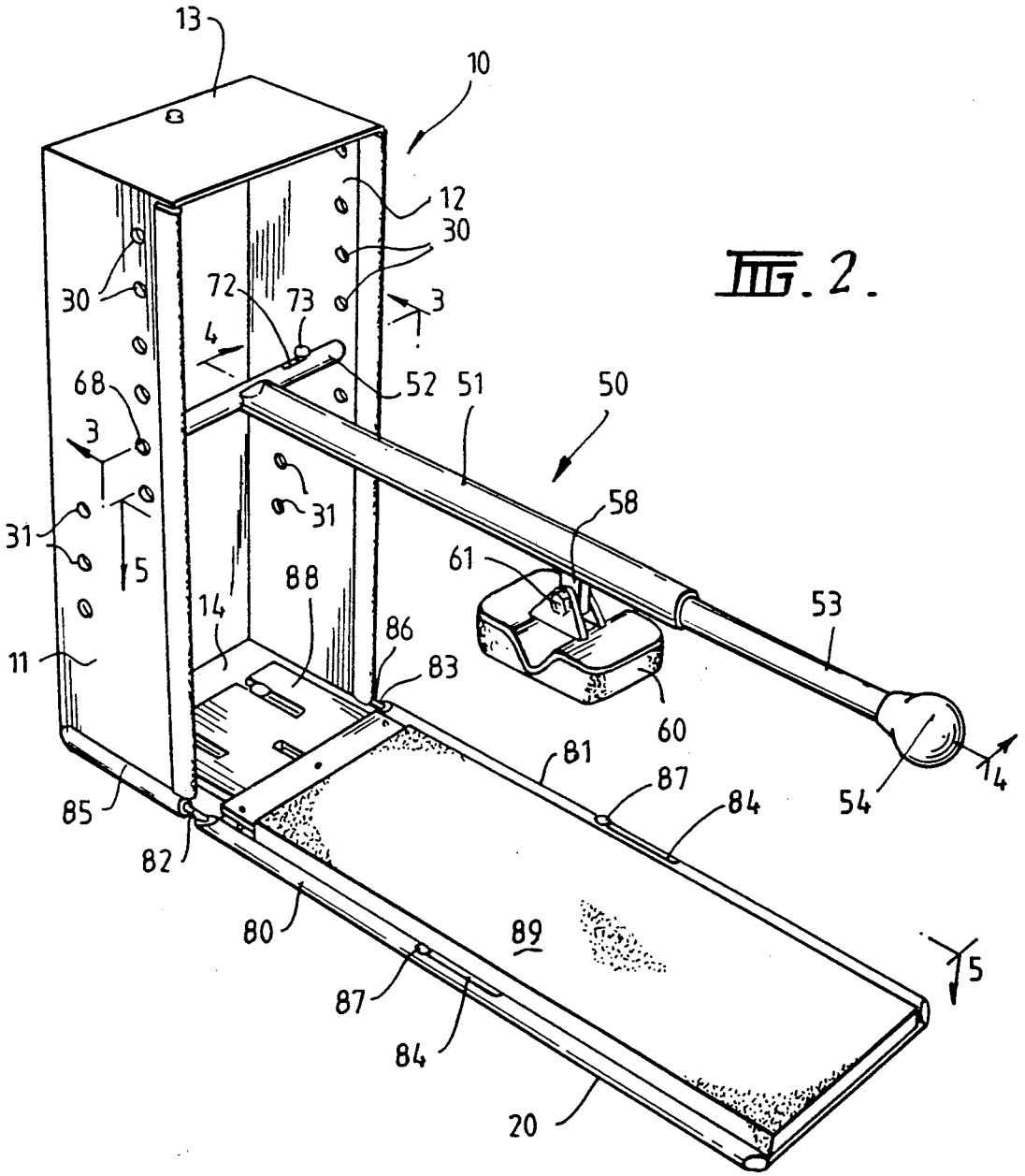
FIG. 2 is a perspective view of the device in the operative position.

A portable device for cardiac massage comprises as shown in the accompanying drawings a rectangular case 10 with elongate side walls 11 and 12 joined by end walls 13 and 14. The case includes a rectangular lid 20 that is pivotally secured to the end wall 14 via a pair of hinges 23, 24 secured to the end 21 of the lid. The other end 25 of the lid carries a location strap 26. The side walls 11 and 12 of the case are provided with two rows of co-axially aligned spaced apart apertures 30 and 31.

Figure 4:
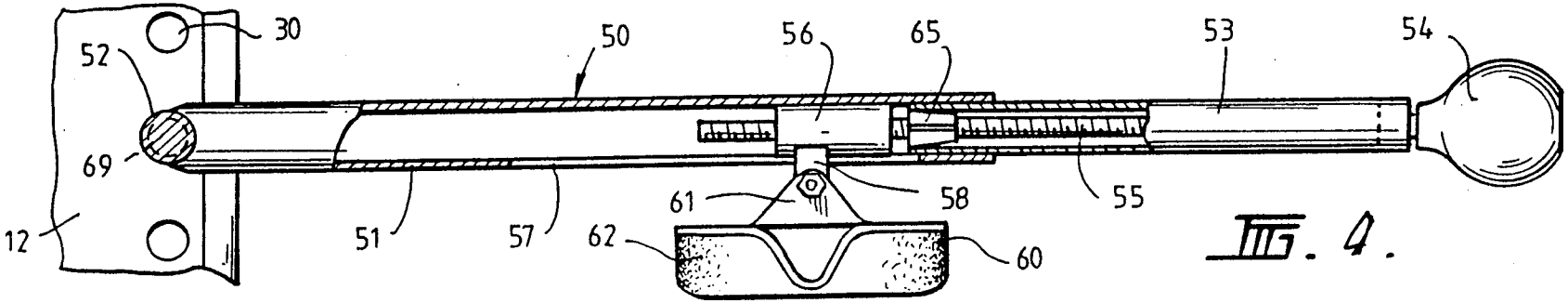
FIG. 4 is a cross-sectional view taken along the lines 4—4 of FIG. 2.
Figure 5:
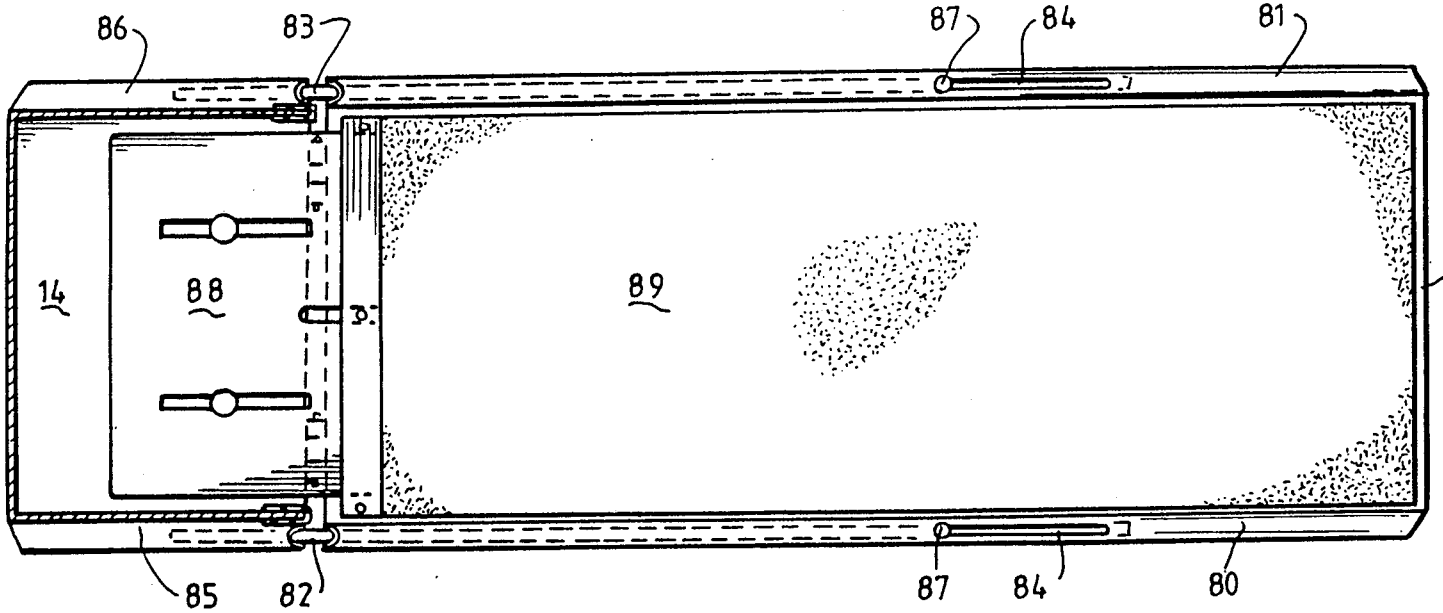
FIG. 5 is a plan view of the device shown in the operative position.

The case 10 is adapted to carry an extensible lever 50 details of which are shown in FIGS. 2, 3 and 4. The extensible lever 50 comprises a first rod 51 that terminates at one end in a transverse tubular bar 52 that is welded to the end of the rod 51. The first rod 51 is arranged to telescopically accommodate a second rod 53 which terminates in a knob 54 supported on a threaded bolt 55 that extends along the length of the second rod 53 to extend into the adjacent end of the first rod 51. An internally threaded collar 56 is located on the bolt 55 and has external dimensions to allow it to be a sliding fit within the first and outer rod 51. The underside of the outer rod is provided with a elongate slot 57 which accommodates a downwardly extending flange 58 of the sleeve 56 that supports a contact pad 60 about a nut and bolt 61 to allow pivotal movement in a vertical plane as shown in FIG. 4. The inner rod 53 is arranged to be a sliding fit within the outer rod 51 so that the lever 50 is extensible and the position of the pad 60 is variable along the length of the lever. A tapered locking wedge 65 is also threadedly supported by the bolt 55 and when the length of the lever has been selected, the knob 54 can be turned to cause the threaded taper 65 to force the wall of the inner rod 53 into positive engagement with the adjacent wall of the outer rod 51 thereby locking the rods together.

In FIG. 3, there is an illustration of the transverse rod 52 showing a fixed end projection 68 at one end and a spring loaded pin 69 at the other that operates against a coil spring 70 positioned within a bore 71 within the rod 52. A cut-out 72 is provided in an upper surface of the rod and the pin 69 has an outwardly extending abutment 73 that can be finger operated to cause the pin to slide into the bore of the rod thereby allowing a simple and effective location of the transverse rod across the holes 30 or 31 in the side walls of the case.

As can be seen with particular reference to FIG. 2, when the case is opened and stood on its end wall 14 in a vertical array with the lid 20 lying flat and horizontally the array of holes 30 provide six positions for the lever 50. The second array of holes 31 is positioned lower than the first array 30 and provides a further three positions for the lever 50.

The device is also provided with means positioned in the lid 20 to lock the lid in the open position shown in FIG. 2. Each side of the lid 20 terminates in a cylindrical sleeve portions 80 and 81 and a rod bar 82, 83 is positioned within each sleeve to be displaceable along the sleeve by finger operation of a upstanding projection 87 that is a sliding fit within a slot 84 in the upper surface of the sleeves 80 and 81. The rods 82, 83 are arranged to slidingly locate within similar outer rods 85, 86 positioned at the base of the side walls 11 and 12 of the case. As a further means of locating the lid open in the horizontal position as shown in FIG. 2, a plate 88 is arranged to be a sliding fit on the inside of the end wall 14 of the case. The plate 88 is arranged to slide within a gap defined between inner and outer portions of the lid 20. The inside surface of the lid 20 is covered with a thin strip of polymeric material 89.

To operate the device, the case is opened, the lid positioned as shown in FIG. 2 and locked in this position through the means described above. The patient is then laid chest upwards on the inner surface of the lid 20 with his or her head adjacent the case. The lever is then positioned in one of the pairs of holes in the upstanding side walls of the case at a position so that the contact pad is directly above the sternum of the patient The length of the lever is also selected so that the contact pad is directly positioned above the patient's chest. The length of the lever is then locked by turning the knob 54 at the end of the lever and cardiac massage can commence. Cardiac massage is implemented by a downward force on the knob 54 causing the pad to cause compression of the sternum of the patient. The fact that the lever is comparatively long and the force acts at a substantial distance from the pivot point causes considerable moment thus increasing the downward force on the patient. The contact pad 60 is designed, as described earlier, to pivot in a vertical plane and includes a suitably profiled polymeric pad 62 that is designed to be a close fit on the central portion of the chest of the patient. In tests of the device, it has been discovered that even an untrained person can effectively apply cardiac massage using equipment of this kind. An untrained person can for a period of thirty minutes or more apply cardiac massage to a patient without becoming totally exhausted. The device provides a simple yet effective means of cardiac massage for both trained and untrained operator. The device also has the advantage that it is simple to disassemble the lever, slide the rods one within the other and then store it in the case. The case not only operates as storage for the massage device but provides an adequate support for its use with the lid acting as a firm surface on which cardiac massage must take place.

Although not shown in FIG. 2, the contact pad 60 may incorporate a spring that operates in a vertical plane. The spring can emit an audible signal if so much force is applied, for instance when the device is being used on a small child. In a more sophisticated embodiment the spring rate may be adjustable.

Other features not illustrated concern the provision of straps that hold the patient in position on the lid of the case.

In a further embodiment of the invention not illustrated, it is understood that in certain circumstances the lever could be directly applied to some other form of support that would form part of an ambulance or first aid facility.

Having now described my invention, what I claim is:

1. A portable device for cardiac massage of a patient comprising:

a portable elongate case including
- an opening,
- a lid,
- a mounting means for mounting said lid to said case in a closed position in which said lid closes said opening of said case, and
- a locking means for locking said lid in an opened position in which said lid extends away from said opening of said case and in which said lid is locked to a remainder of said case against relative movement of said lid in a plane;

a lever which is receivable in said case when said lid is in the closed position, said lever having
- a first end,
- a free end, and
- a remainder between said first end and said free end;

a positioning means for detachably mounting said first end of said lever at a variety of positions in said case when said lid is in the opened position so that said remainder of said lever extends out of said opening of said case and for pivotally mounting said first end of said lever so that said remainder of said lever is pivotable about said first end and in the plane toward and away from said lid; and a contact pad attached to said remainder of said lever and projecting toward said lid when said first end of said lever is mounted in said case;

such that is use with said lid locked in the opened position a back of the patient is positioned against said lid and said first end of said lever is positioned so that said contact pad is positioned over a sternum of the patient, and whereby cardiac massage is applied to the patient by repeatedly pressing on said free end of said lever to repeatedly engage said contact pad with the sternum of the patient.

2. A portable device for cardiac massage as claimed in claim 1 wherein said lever is extensible and is formed of a first part including said first end and a second part which is telescopically fit with said first part; and wherein said contact pad is attached to said second part whereby displacement of said second part relative to said first part varies a length of said lever and a distance of said contact pad from said remainder of said case.

3. A portable device for cardiac massage as claimed in claim 2 wherein said second part of said extensible lever includes a rotatable knob and an engagement means operated by a rotation of said knob for movement between an engaging position where said first and second parts are telescopically immovable and a free position where said first and second parts are telescopically movable.

4. A portable device for cardiac massage as claimed in claim 1 wherein said contact pad is formed of a malleable plastics material in order to fit closely to the sternum of the patient.

5. A portable device for cardiac massage as claimed in claim 1 wherein said case includes an end, and wherein said mounting means mounts said lid to said end for pivotal movement between the closed and opened positions.

6. A portable device for cardiac massage as claimed in claim 1 wherein said first end of said lever includes a transverse bar attached perpendicularly to the remainder of said lever, a movable projection extending longitudinally from said transverse bar, and a spring means for urging said projection away from said transverse bar such that by moving said projection against the urging of said spring means said transverse bar is easily located in said positioning means.

* * * * *